US006167944B1

(12) United States Patent
Ricketts et al.

(10) Patent No.: US 6,167,944 B1
(45) Date of Patent: Jan. 2, 2001

(54) INGOT MOULD SYSTEM

(75) Inventors: Nigel Jeffrie Ricketts, Forest Lake (AU); Phillip Wilmott Baker, Oakville (CA)

(73) Assignees: Commonwealth Scientific and Industrial Research Organisation, Australian Capital Territory; Australian Magnesium Corp. Pty. Ltd., Queensland, both of (AU)

( * ) Notice: Under 35 U.S.C. 154(b), the term of this patent shall be extended for 0 days.

(21) Appl. No.: 09/077,506

(22) PCT Filed: Dec. 13, 1996

(86) PCT No.: PCT/AU96/00804

§ 371 Date: Sep. 8, 1998

§ 102(e) Date: Sep. 8, 1998

(87) PCT Pub. No.: WO97/21510

PCT Pub. Date: Jun. 19, 1997

(30) Foreign Application Priority Data

Dec. 14, 1995 (AU) ..... PN7161

(51) Int. Cl.[7] ..... B22D 11/06; B22D 5/04

(52) U.S. Cl. ..... 164/479; 164/66.1; 164/130; 164/324; 164/430; 164/475

(58) Field of Search ..... 164/66.1, 130, 164/324, 329, 330, 427, 429, 430, 479, 415, 475

(56) References Cited

U.S. PATENT DOCUMENTS

| | | | | |
|---|---|---|---|---|
| 2,389,983 | | 11/1945 | Johnson . | |
| 4,565,234 | * | 1/1986 | Rimbert | 164/66.1 |
| 4,576,220 | * | 3/1986 | Smyth et al. | 164/66.1 |

FOREIGN PATENT DOCUMENTS

| | | |
|---|---|---|
| 0 327 485 | 8/1989 | (EP) . |
| 96 94 0635 | 12/1999 | (EP) . |

* cited by examiner

*Primary Examiner*—Kuang Y. Lin
(74) *Attorney, Agent, or Firm*—Rodman & Rodman

(57) ABSTRACT

An apparatus (10) for casting metal ingots comprises a series of ingot moulds (12) mounted along an endless conveyor (11) which is arranged to be driven around spaced-apart rotatable members (15) and (17). A molten metal supplying device (20) has a discharge member for supplying molten metal to empty moulds (12) moving along an upper run (14) of the conveyor (11) from a supply end (16) to a discharge end (18) of the upper run (14) of the conveyor (11). A casting hood (13) overlies at least a portion of the moulds (12) on the upper run (14) of the conveyor (11). Adjacent moulds (12) of the portion of moulds are closely contiguous during passage beneath the casting hood (13) whereby passage of protective gas between said adjacent moulds is minimized. The casting hood (13) and the portion of moulds (120) form a substantially gas-tight enclosure above the portion of moulds (12) into which gas can be introduced. The enclosure houses the discharge member of the molten metal supplying device (20).

14 Claims, 4 Drawing Sheets

INGOT MOULD SYSTEM

FIELD OF THE INVENTION

The present invention relates to an improved method and system for ingot mould casting of metals. More particularly, the present invention relates to an apparatus for casting metal ingots, a mould for use in the apparatus, a method which utilises the apparatus, and metal cast by the method.

BACKGROUND OF THE INVENTION

The use of an ingot mould to cast molten metals is common practice. Casting of metals under an inert or protective gas atmosphere also is well known and is essential in the case of some metals such as magnesium.

In casting metals in ingot moulds, a system which is frequently used has a series of moulds mounted along an endless conveyor by which the moulds are presented in turn to a molten metal supply or distribution device. The conveyor, which may comprise endless chains or belts, passes around longitudinally spaced cogs, sprockets or the like, by which drive is imparted to the conveyor. The series of moulds is mounted on the conveyor so as to be in an upright orientation when presented to the supply or distribution device on an upper run of the conveyor. Typically the moulds are inverted in turn as each passes around a cog, sprocket or the like at a discharge end of the conveyor, such that the then sufficiently solidified ingot therein is able to drop from its mould.

With such a conventional conveyor system, it is difficult to restrict adequately the amount of air ingress to the atmosphere above the moulds and/or the amount of inert or protective gas atmosphere that leaks between moulds or otherwise is lost. Of course, it is possible to house the entire system in a leakproof enclosure, and to have the molten metal supply or distribution device within the enclosure. However, this substantially increases overall capital costs, and gives rises to several practical difficulties in operation, not the least of which is difficulty of access to the system in the event of a malfunction, particularly where the inert or protective gas is toxic.

SUMMARY OF THE INVENTION

In a first aspect, the present invention provides an apparatus for casting metal ingots comprising:

- a series of ingot moulds mounted along an endless conveyor which is arranged to be driven around spaced apart rotatable members;
- a molten metal supplying device having a discharge member for supplying molten metal to empty moulds moving along an upper run of the conveyor from a supply end to a discharge end of the upper run of the conveyor;.
- a casting hood overlying at least a portion of the moulds on the upper run of the conveyor and being in slideable sealing engagement with the portion of the moulds, adjacent moulds of the portion of moulds being closely contiguous during passage beneath the casting hood whereby passage of gas between said adjacent moulds is minimised, the casting hood and the portion of moulds forming a substantially gas tight enclosure above the portion of moulds, the enclosure housing the discharge member of the molten metal supplying device; and
- gas introduction means for introducing gas into the enclosure.

In a second aspect, the present invention provides a method for casting molten metal utilising an apparatus according to the first aspect of the present invention, the method comprising the steps of driving the series of ingot moulds around the spaced apart rotatable members, introducing gas into the enclosure to establish and maintain an atmosphere of the gas within the enclosure, and supplying molten metal from the discharge member to successive moulds moving below the casting hood.

In a third aspect, the present invention provides a metal cast by a method according to the second aspect of the present invention.

Preferably, the spaced apart rotatable members comprise longitudinally spaced cogs, sprockets or the like. Preferably, sides of said adjacent moulds are substantially normal to the direction of movement of the moulds along the upper run of the conveyor. Preferably, the casting hood is mounted above, and extends along, the upper run and along each side of the conveyor.

The moulds may be of rectangular form in plan view. While this is not necessarily the case, particularly in relation to the cavity of each for casting an ingot, such form will be assumed for ease of description. In line with that assumption, it will be further assumed that each mould is of similar form and dimensions and that each has a rectangular open top bounded by substantially parallel sides which are substantially perpendicular to the length of the conveyor, and a respective end which extends along each side of the conveyor. However, it is to be noted that these further assumptions also do not necessarily apply.

On the upper run of the conveyor, successive moulds may be closely contiguous along adjacent sides of the open top of each. The arrangement may be such that the adjacent sides simply abut at opposed surfaces thereof. Alternatively, the adjacent sides may interfit or interlock. In each case, the adjacent sides preferably conform to close tolerances, so as to minimise the gap between the successive moulds and, hence, the extent to which inert or protective gas atmosphere provided above the moulds is able to escape during movement of the moulds along the upper run. However, whether abutting, interfitting or interlocking, it is necessary that successive moulds are closely contiguous on the upper run of the conveyor in a manner which enables their separation as each mould reaches and moves around the discharge end of the conveyor.

In accordance with a fourth aspect of the present invention, a mould may comprise a substantially rectangular base, a pair of end walls and first and second side walls, the end walls and side walls extending upwardly and outwardly from the base, the side walls being longer than the end walls and the first side wall being taller than the second side wall, the first side wall having an outwardly extending first side wall lip having a concave underside and the second side wall having an outwardly extending second side wall lip having a convex upperside, the first and second side wall lips being arranged such that when two of the moulds are placed horizontally beside one another the concave underside of the first side wall lip of a first of the two moulds sits atop the convex upperside of the second side wall lip of a second of the two moulds whereby passage of gas between the first side wall of the first mould and the second side wall of the second mould is minimised.

In one arrangement, each side of the open top of each mould is defined by an outwardly turned lip, one of which is slightly higher than the other. The higher lip of one of successive moulds, for example the leading lip in the direction of movement along the upper run, can overlap the lower lip of the other of the successive moulds. The lips may be arcuate in sections parallel to that direction, such that a convex upper surface of the lower lip is received under a concave lower surface of the upper lip. Where of such arcuate form, the lips may have a radius of curvature which facilitates separation of the leading one of the successive moulds when it reaches the discharge end of the conveyor. Also, in that arrangement, the higher lip preferably is at substantially the same height as the ends of the open top such that, in being received over the lower lip of the next successive mould, it is neatly received between the ends of the open top of that next mould.

The casting hood may be of elongate form in plan view. Also, it may have a respective side structure along each side of the conveyor by which it is in slideable sealing engagement with at least a plurality of successive moulds on the upper run, and a cover which extends between the side structures, above these moulds. That sealing engagement may be provided along ends of the open top of each of the moulds, and preferably is of a tongue and groove type. In one form, each of those ends has a groove therein into which an edge of the respective side structure is received. Each groove preferably is defined in an upper surface of its end. However, a converse arrangement is possible, in that each end of the open top of each mould may define a rib which is received in a groove of the respective side structure, with each rib preferably defined on an upper surface of its end.

With each of the tongue and groove types of sealing engagement, the engagement preferably is substantially continuous along the length of the conveyor along which the casting hoods extends. Thus, where grooves are defined in the ends of the open top of each mould, the grooves in adjacent ends of successive moulds preferably are substantially aligned and in close end-to-end relation. Similarly, where each end defines a rib, the ribs of adjacent ends of successive moulds preferably are substantially aligned and in close end-to-end relation. In each case, the tongue and groove type of engagement provides a form of labyrinth seal which creates a tortuous path acting to minimise gas loss from within, or ingress of ambient air to, the space within the casting hood, above moulds therein.

As will be appreciated, each mould cools somewhat after releasing an ingot cast therein on passing around the discharge end of the conveyor, and during its return via the supply end of the conveyor to the filling position. On reaching the filling position and receiving molten metal, each mould will be heated. The system thus needs to allow for thermal expansion and contraction of the moulds during such cooling and heating. Such allowance may be provided by the side structures of the casting hood. In one form providing such allowance, at least that part of each side structure which provides slideable sealing engagement with the moulds is resilient and able to flex to accommodate thermal expansion and contraction of the moulds. At least that part of the side structure may be formed of a suitable heat resistant cloth, with this material preferably being used with a tongue and groove type of seal in which the groove is defined by the moulds. In an alternative form, that part of each side structure which provides slideable sealing engagement with the moulds may be relatively rigid, and made, for example, of a suitable metal, but able to move to accommodate the thermal variation by being able to adjust laterally of the conveyor in sealing relationship with an associated part of its side arrangement.

It also will be appreciated that moulds moved by the conveyor along the upper run will undulate somewhat, despite manufacture to the closest tolerances and despite the moulds being closely contiguous. It therefore is desirable that the slideable sealing engagement between the moulds and side structures of the casting hood be able to accommodate this. Thus, where for example, that engagement is of a tongue and groove type, with the grooves opening vertically, the depth of the engagement within the grooves can be sufficient to allow for variation in height of successive moulds due to any undulations.

As described to this stage, the casting hood will be understood as being of a form in which the space above successive moulds on the upper run of the conveyor is closed by side structures of the hood, and a cover which extends between the sides. The hood also is adapted for the supply of inert or protective gas to that space so to substantially comprise the atmosphere therein. Additionally, the hood is adapted to enable the casting of molten metal therein in each of the successive moulds, as each mould reaches a filling position. Moreover, the casting hood has an inlet structure and an outlet structure spaced along the conveyor, by which it engages moulds moving along the upper run to minimise ingress of ambient air to and loss of atmosphere from the space enclosed by the hood.

Each of the inlet and outlet structures of the casting hood preferably comprises an airlock. Where this is the case, each structure may comprise a longitudinally spaced pair of wall members, each joined to the cover and extending between and joined to the side structures. A lower edge of each wall of the pair bears against the top of successive mould passing thereunder. Preferably, the spacing between the walls of each pair exceeds the spacing between the sides of each mould so as to maximise retention of sealing integrity at each end of the casting hood. The walls of each pair may be adapted to resiliently engage the top of successive moulds. For this purpose, the walls may be formed of flexible, heat resistant cloth, so as to resiliently bear against the top of successive moulds. Alternatively, the walls may be rigid, but have a lower edge formed of such fabric so as to provide resilient engagement with the moulds.

The casting hood may be adapted for the supply of inert or protective gas to the space therein by having a gas supply conduit extending to the hood from a source of supply of the gas. The conduit may simply communicate with the space, such as through a side structure or the cover of the hood. However, the conduit preferably communicates with at least one distribution duct of the hood which extends longitudinally therein and has a plurality of outlets from which the gas can be discharged into the space. The gas preferably is supplied to the space so as to maintain the atmosphere therein at a slight overpressure sufficient to prevent the ingress of ambient air.

The inert or protective gas preferably is supplied to the space such that the gas substantially comprises the atmosphere within the casting hood. By way of example, the inert gas may be nitrogen, argon, or a mixture of nitrogen and argon and the protective gas may be a dilute sulphur hexafluoride/dry air mixture, a dilute sulphur hexafluoride/carbon dioxide mixture, a dilute sulphur hexafluoride/dry air/carbon dioxide mixture, or a sulphur dioxide/dry air mixture. Where the inlet and outlet structures comprise airlocks, the gas preferably is supplied to that part of the space between those structures, as well as to the part of the space between the pair of walls of at least the inlet structure. As will be appreciated, each mould approaching the inlet structure will have ambient air in its cavity, and the inert or protective gas supplied in the airlock comprising that structure most preferably is directed so as to flush the ambient air from successive moulds, prior to each mould passing in turn beyond the airlock.

The casting hood may be adapted to enable the casting of molten metal therein, in each of successive moulds, in a variety of ways. Preferably the molten metal is supplied to the casting hood, from a source of supply, via a supply pipe which communicates with a molten metal distribution device located within the hood at a pouring position. The distribution device may comprise a discharge head which defines an outlet end of the supply pipe. In this case, the supply of molten metal may be controlled so as to be terminated for an interval between completion of filling of each mould in turn, when in a filling position, and the arrival of the next following mould at that position. However, the distribution device may be continuously operable and comprise, for example, a rotatable casting wheel member having a plurality of spouts which are operable in turn for filling successive moulds at the filling position.

Over at least an inlet part and an outlet part of its length, the casting hood may be relatively shallow, so as to minimise the volume of inert or protective gas required to provide the atmosphere therein. Where the metal distribution device comprises a discharge head, the hood may be of similar shallow form over its full length. However, where the distribution device is of larger form, such as a rotatable casting wheel member, the height of the casting hood at the region of the filling position for moulds may be large so as to define a chamber adjacent the filling position, in which the discharge device is housed and operable.

BRIEF DESCRIPTION OF DRAWINGS

Preferred embodiments of the present invention will now be described, by way of example only, with reference to the accompanying drawings, in which.

DETAILED DESCRIPTION OF THE DRAWINGS

Figure 1:
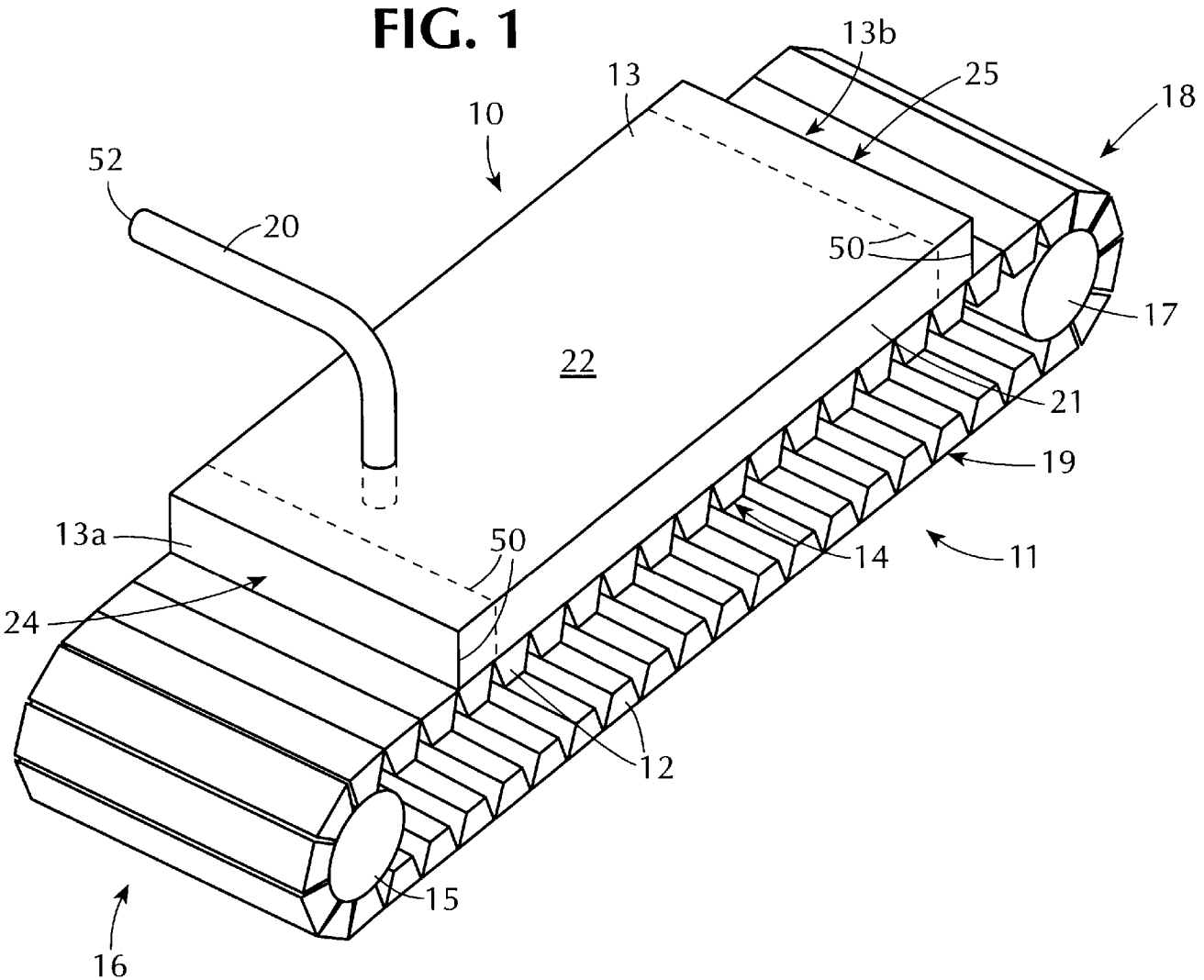
FIG. 1 is a schematic perspective view of a system for ingot mould casting of a metal.
Figure 2:
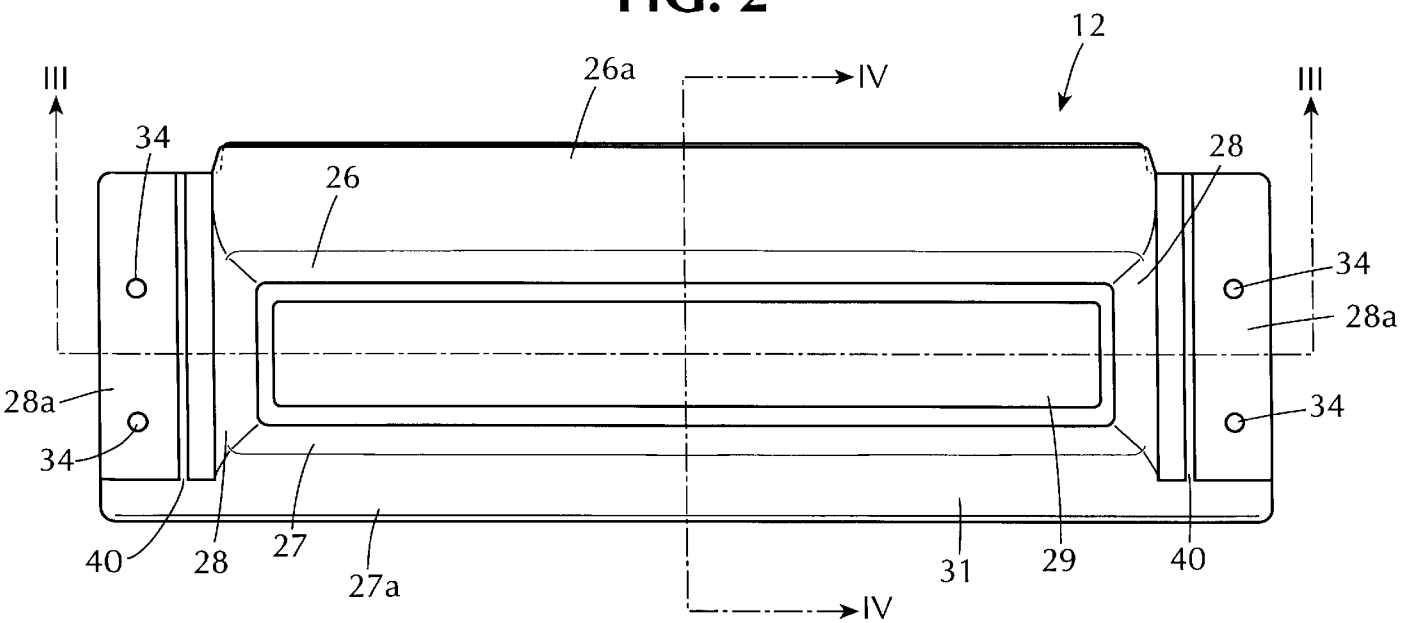
FIG. 2 is a plan view of an ingot mould of the system of FIG. 1.
Figure 3:
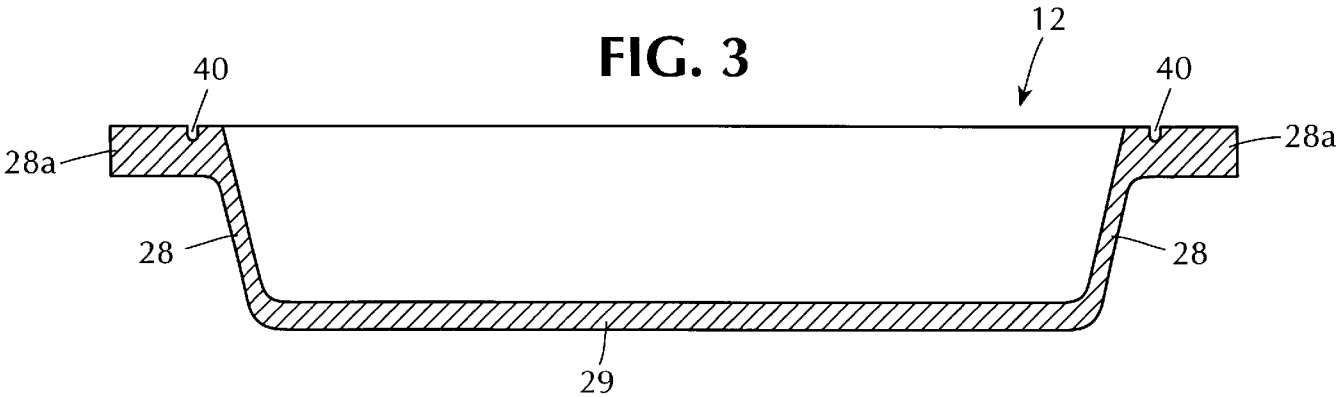
FIG. 3 is a sectional view taken on line III—III of FIG. 2.

Referring firstly to FIG. 1, the system 10 comprises a horizontally disposed conveyor 11 having ingot moulds 12 mounted thereon and a casting hood 13 mounted over a plurality of the moulds 12 on an upper run 14 of conveyor 11.

Conveyor 11 comprises endless chains or an endless belt which passes around a first rotatable member 15 at a supply end 16 of the conveyor 11 and a second rotatable member 17 at a discharge end 18 of the conveyor 11. Members 15 and 17 comprise cogs, sprockets or the like; one of which is driven so as to cause conveyor 11 to move successive moulds 12 from the supply end 16 to the discharge end 18, along the upper run 14, and then to return the moulds 12 along a lower run 19 to the supply end 16.

Hood 13 extends longitudinally above the upper run 14 over a plurality of moulds 12 thereon. The longitudinal extent of hood 13 is such that it has an inlet end 13*a* downstream of the supply end 16 and an outlet end 13*b* upstream from the discharge end 18. The length of conveyor 11 between supply end 16 and inlet end 13*a* may be relatively short. However, the length of conveyor 11, from outlet end 13*b* to the discharge end 18 needs to be such that molten metal poured into successive moulds 12 via a molten metal supply line 20 between ends 13*a* and 13*b* is able to solidify sufficiently before the moulds 12 pass around the discharge end 18 and are inverted to discharge ingots.

Hood 13 has a respective side wall structure 21 above each side of conveyor 11, a top cover 22 which extends between the top edge of each side wall structure 21, an inlet structure 24 at inlet end 13*a* and an outlet structure 25 at outlet end 13*b*. These features of hood 13 will be subsequently described in more detail. However, it is to be appreciated that hood 13 substantially encloses a space above moulds 12 as they pass from inlet end 13*a* to outlet end 13*b*. Also, hood 13 has a connector means (not shown) which is connectable to a source of pressurised inert or protective gas and is adapted for discharge of the gas within hood 13.

Referring now to FIGS. 2–6, each mould 12 is of elongate rectangular form, with a leading side wall 26, a trailing side wall 27 and end walls 28 which are inclined upwardly and slightly outwardly with respect to a base 29 for ease of discharge of an ingot cast therein. Moulds 12 are disposed with their side walls 26 and 27 extending laterally across conveyor 11, and with each end wall 28 adjacent and extending along a respective side of conveyor 11.

Figure 4:
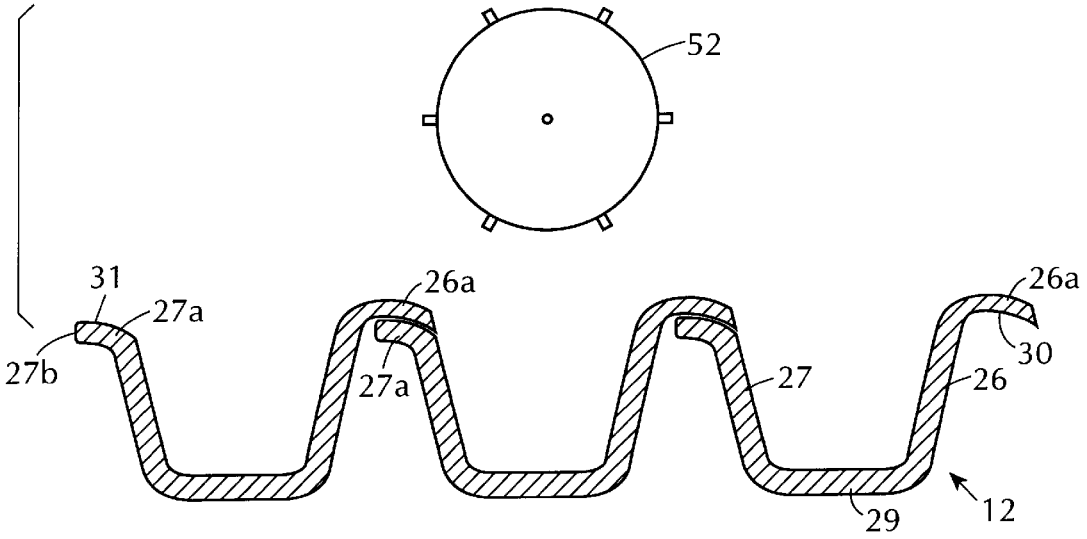
FIG. 4 is a sectional view taken on line IV—IV of FIG. 2 and showing in simplified schematic form a rotatable casting wheel as a filling station alternative.
Figure 5:
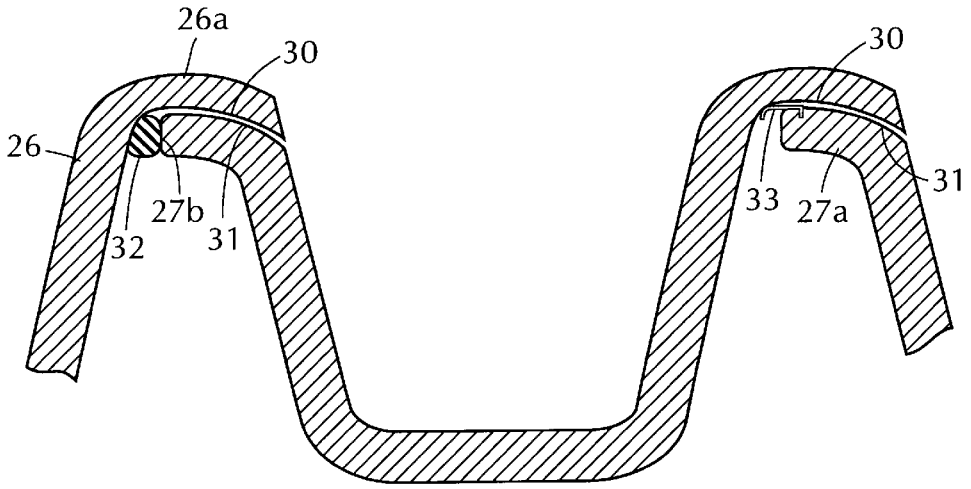
FIG. 5 corresponds to FIG. 4, but additionally shows sealing means between adjacent ingot moulds.

In each mould 12, the leading side wall 26 is of substantially the same height as end walls 28, although the trailing side wall 27 is of slightly lesser height. Also, each side wall 26 and 27 and each end wall 28 has an outwardly extending lip or flange, respectively designated lips 26*a*, 27*a* and 28*a*. The lips 26*a* and 27*a* are of arcuate cross-section with the form of leading lip 26*a* defining a concave lower surface 30 (see FIGS. 4 and 5) which is substantially complimentary to a convex upper surface 31 of trailing lip 27*a*. As best illustrated in FIGS. 4 and 5, the leading lip 26*a* extends over the trailing lip 27*a* of a preceding mould 12. For this arrangement, the length of the leading lip 26*a* is such that it is able to be neatly received between the end walls 28 of the preceding mould 12. Successive moulds 12 on the upper run 14 thus interfit or interlock, so as to be closely contiguous. This preferably is such that, for moulds 12 below hood 13, loss of inert or protective gas between successive moulds is able to be minimised, due to surfaces 30 and 31 being closely adjacent or in contact.

The relationship between overlapped lips 26*a* and 27*a* of adjacent moulds 12 is such that the adjacent moulds 12 are able to separate on passing around the supply and discharge ends 16 and 18 respectively of conveyor 11. On passing fully around ends 16 and 18, the lips 26*a* and 27*a* resume their overlapping relationship.

The gas sealing may be improved by providing sealing means between adjacent moulds 12 (see FIG. 5). The sealing means may take a variety of forms including a compressible seal 32 which extends longitudinally along the end 27*b* of trailing lip 27*a* and which is arranged to compress and provide a gas tight seal adjacent to the junction of the leading wall 26 and the leading lip 26*a* of the following mould as the moulds 12 move about first rotatable member 15 and approach inlet end 13*a* of the hood 13. The gas tight seal between adjacent moulds 12 then remains intact as the moulds 12 move along the upper run 14 of conveyor 11. Alternatively, the sealing means may take the form of a longitudinal spring steel gasket 33 which is affixed to upper surface 31 of trailing lip 27*a* and which is arranged to compress and bridge between surfaces 30 and 31 to provide a gas tight seal between adjacent moulds 12 during their passage along the upper run 14 of conveyor 11. As with compressible seal 32, spring steel gasket 33 forms the gas tight seal between adjacent moulds 12 as they move about first rotatable member 15 and approach inlet end 13*a*.

The end wall lips 28*a* are flat and horizontally disposed and have a pair of apertures 34 (see FIG. 2) by which moulds 12 are secured to conveyor 11. The pair of apertures 34 receive bolt and nut 35 (see FIG. 6) by which a horizontally disposed arm 36 of an angle bracket 37 is secured to the underside of lip 28*a*. A vertically disposed arm 38 of angle bracket 37 is welded to a link 39 of the conveyor 11.

Additionally, each end wall lip 28*a* has a groove 40 formed in its upper surface which is parallel to the direction of travel of the conveyor 11. The groove 40 of each lip 28*a* is positioned such that, as moulds 12 are moved along the upper run 14 of conveyor 11, each groove 40 is longitudinally aligned and in close end-to-end relationship for successive moulds 12. The grooves 40 enable substantial sealing with hood 13 along each side of conveyor 11.

Figure 6:
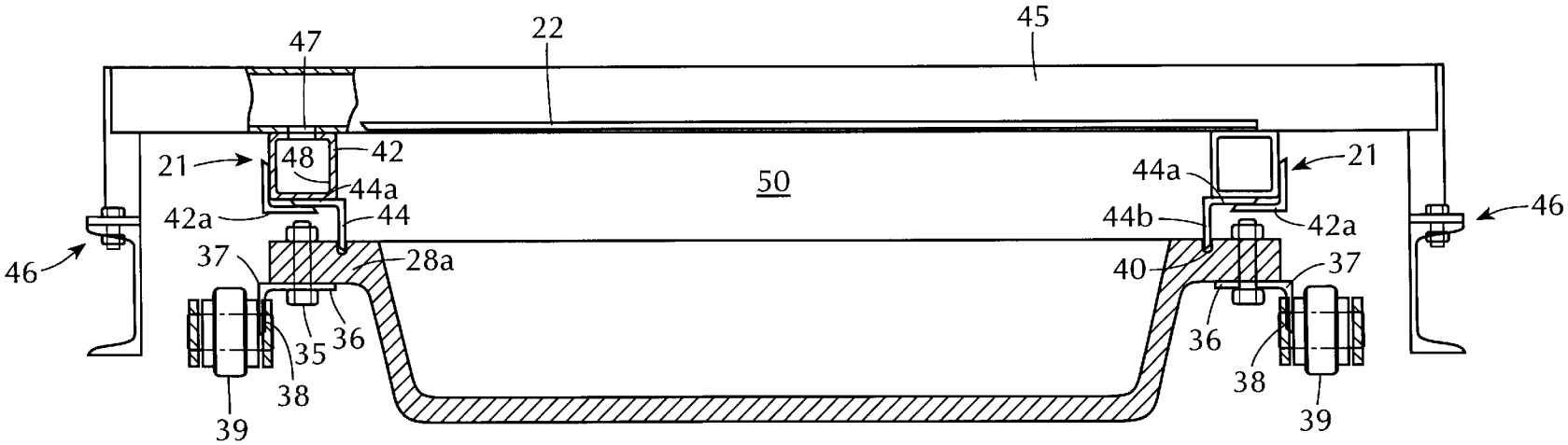
FIG. 6 corresponds to FIG. 3, but additionally shows the ingot mould in relation to other components of the system of FIG. 1.

As shown most clearly in FIG. 6, each side wall structure 21 of hood 13 is of two part form, comprising an upper square section tubular member 42 and an elongate bracket 44 of angle section. Each member 42 and bracket 44 is continuous along substantially the full length of hood 13 between inlet end 13*a* and outlet end 13*b*. However, each member 42 is closed at each end.

Each bracket 44 has a horizontally disposed flange 44*a* on which its tubular member 42 rests, and a vertically disposed flange 44*b* which extends from the inner edge of flange 44*a*. To maintain bracket 44 in relationship to its tubular member 42, the tubular member 42 has secured to its lower side an inturned flange 42*a* which extends laterally below the flange 44*a*. The arrangement is such that bracket 44 is able to adjust laterally with respect to member 42, while a labyrinth seal is maintained therebetween by flange 42*a*.

As moulds 12 pass under hood 13 via inlet end 13*a*, the lower edge of flange 44*b* is received in a respective groove 40 of each mould 12. This relationship is maintained until the mould 12 passes beyond the outlet end 13*b* of hood 13. A resultant tongue-and-groove coupling between brackets 44 and moulds 12 provides a gas seal therebetween, with the tolerances and depth of engagement allowing for undulation of moulds 12 during their movement. Also, the ability of brackets 44 to move laterally relative to tubular members 42 allows for thermal variation in the dimensions of moulds 12.

Cover 22 of hood 13 comprises a metal plate which bridges and rests on the respective tubular members 42. A seal preferably is provided therebetween by a suitable gasket (not shown), as this allows for relative thermal expansion and contraction.

At one or more locations along the length of hood 13 there is provided a transverse square section pipe 45 which bridges and extends beyond tubular members 42 for introducing gas into the space defined by hood 13 above moulds 12. For this purpose pipe 45 has a connector (not shown) for receiving gas from a pressurised source (not shown) and is closed at each end. Pipe 45 is mounted on a side support structure 46 at each side of conveyor 11 with pipe 45 and, hence, side wall structures 21 being maintained at a constant height. Pipe 45 and members 42 are in communication via a port 47 defined by aligned apertures in each. Around each port 47, pipe 45 is welded to each member 42 to provide a gas tight seal. Also, along each member 42, there is a series of holes 48 by which the interior of each member 42 is in communication with the space defined by hood 13 above moulds 12. The arrangement is such that inert or protective gas is able to be supplied from the pressurised source to pipe 45 and then to tubular members 42 via ports 47. From the tubular members 42 the gas is discharged within hood 13 via holes 48 so as to comprise the atmosphere within hood 13. The gas is supplied at a sufficient pressure so that the atmosphere within hood 13 is at a slight overpressure thus preventing the ingress of ambient air. However, the overpressure should be kept to a minimum so as to avoid undue loss of the gas from system 10.

Each of inlet structure 24 and outlet structure 25 comprises an airlock defined by a transverse pair of walls 50 (FIGS. 1 and 6). In each of structures 24 and 25, the longitudinal spacing between the walls 50 preferably exceeds the spacing between leading side wall 26 and trailing side wall 27 of each mould 12. Also each wall 50 is sealed against top cover 22 and each side wall structure 21, respectively across the full transverse and vertical extent of hood 13. Walls 50 are of a substantially gas impervious, flexible and heat resistant cloth, and bear against the upper edges of moulds 12 passing thereunder. The walls 50 thus provide a gas seal at both the inlet end 13*a* and outlet end 13*b* of hood 13. In this regard, ambient air and water vapour resulting from cooling of the moulds after discharge of ingots will be taken into the inlet end 13*a* by successive empty moulds 12. However, each mould 12 in turn initially will be between the pair of walls 50 of inlet structure 24 and, as tubular members 42 discharge inert or protective gas between those walls 50 via holes 48, as well as between inlet and outlet structures 24 and 25, the ambient air and water vapour will be displaced by the gas before each mould 12 in turn passes under the second, innermost one of the walls 50. A similar functioning occurs with the walls 50 of the outlet end structure 25, although there is less need for a double wall arrangement in this case.

Between its inlet and outlet structures 24 and 25, hood 13 has a length accommodating a plurality of successive moulds 12 thereunder. At an intermediate position along that length, system 10 includes a molten metal filling station (not shown) below which each mould 12 is presented in turn to receive a quantity of molten metal to be cast therein. The filling Station may comprise a supply line 20 (see FIG. 1) which extends through hood 13 and is adapted at an outer end 52 to receive molten metal from a suitable source (not shown) for discharge via a discharge head (not shown) into a mould 12 within hood 13. In such a case, hood 13 may be of substantially constant height throughout, as shown. Alternatively, the filling station may comprise a casting wheel member 52 such as shown in simplified schematic form in FIG. 4 which is rotatable to supply molten metal to each of successive moulds 12 via a respective one of a plurality of spouts. In the latter case, it may be necessary for hood 13 to have inlet and outlet end portions of substantially uniform height and an intermediate portion of increased height in which the casting wheel member is housed for rotation.

An ingot mould casting system as shown in FIGS. 1 to 6 has been successfully used for the casting of magnesium ingots, using a dilute sulphur hexafluoride ($SF_6$)/dry air gas mixture as a protective cover gas. The system was found to function efficiently, restricting the amount of ambient air ingress and minimising the amount of $SF_6$ that was lost from the system. Published data suggests a lowest rate of cover gas consumption of 0.7 kg/tonne of magnesium cast. However, with operation with the system of the present invention, it has been found that this consumption level can be reduced by at least 50%. At current prices for $SF_6$ (AU$60/kg), this would result in a saving of over AU$1, 26M for a 60000 tonnes per year casting operation.

While the invention has particular application in ingot mould casting of magnesium, it also is applicable with benefit to the casting of other metals. Recent unpublished work has suggested that if aluminium were cast under an inert gas, a substantial reduction or complete elimination of dross formation may be possible. Dross presently needs to be skimmed from the top of a solidifying aluminium ingot to provide a clean, flat surface to enable efficient, automated ingot stacking. From experience with the system of the present invention, the problem of dross formation and the resultant need for skimming might be avoided with use of the system for casting aluminium under an inert gas. The system of the present invention may also have application for the casting of other metals, such as lead.

What is claimed is:

1. An apparatus for casting metal ingots comprising:

a series of ingot moulds mounted along an endless conveyor which is arranged to be driven around spaced apart rotatable members;

a molten metal supplying device having a discharge member for supplying molten metal to empty moulds moving along an upper run of the conveyor from a supply end to a discharge end of the upper run of the conveyor;

a casting hood overlying at least a portion of the moulds on the upper run of the conveyor and comprising a pair of side walls and a cover extending between the side walls above the portion of moulds, a lower edge of each side wall of the casting hood being received in a groove in an end wall of each of the portion of moulds, adjacent moulds of the portion of moulds being closely contiguous during passage beneath the casting hood whereby passage of gas between said adjacent moulds is minimised, the casting hood and the portion of moulds forming a substantially gas tight enclosure above the portion of the moulds, the enclosure housing the discharge member of the molten metal supplying device; and gas introduction means for introducing gas into the enclosure.

2. An apparatus as claimed in claim 1 wherein sides of said adjacent moulds are substantially normal to the direction of movement of the moulds along the upper run of the conveyor.

3. An apparatus as claimed in claim 1 wherein the grooves in adjacent end walls of the portion of moulds are substantially aligned and in close end-to-end relation.

4. An apparatus as claimed in claim 1 wherein the casting hood further comprises an inlet end comprising a plurality of longitudinally spaced apart inlet end walls extending downwardly from the cover and between the side walls with a lower edge of each inlet end wall arranged to bear against successive moulds passing thereunder.

5. An apparatus as claimed in claim 4 wherein there are two inlet end walls which are spaced apart by a distance greater than the width of a mould.

6. An apparatus as claimed in claim 4 wherein each inlet end wall or a portion including the lower edge thereof is formed from flexible heat resistant cloth.

7. An apparatus as claimed in claim 1 wherein the gas introduction means comprises at least one gas distribution duct having a plurality of outlets for discharging gas into the enclosure.

8. An apparatus as claimed in claim 1 wherein the molten metal supplying device comprises a rotatable casting wheel having a plurality of spouts which are operable in turn for filling successive moulds as they move along the upper run of the conveyor.

9. An apparatus as claimed in claim 1 wherein adjacent sides of said adjacent moulds abut one another.

10. An apparatus as claimed in claim 1 wherein adjacent sides of said adjacent moulds interfit or interlock with one another and are arranged to separate from one another during movement around the supply and discharge ends of the conveyor.

11. An apparatus as claimed in claim 10 wherein each mould comprises a substantially rectangular base, a pair of end walls and first and second side walls, the end walls and side walls extending upwardly and outwardly from the base, the side walls being longer than the end walls and the first side walls being taller than the second side wall, the first side wall having an outwardly extending first side wall lip having a concave underside and the second side wall having an outwardly extending second side wall lip having a convex upperside, the first and second side wall lips being arranged such that when two of the moulds are placed horizontally beside one another the concave underside of the first side wall lip of a first of the two moulds sits atop the convex upperside of the second side wall lip of a second of the two moulds whereby passage of gas between the first side wall of the first mould and the second side wall of the second mould is minimised.

12. A method for casting molten metal utilising an apparatus as claimed in claim 1, the method comprising the steps of driving the series of ingot moulds around the spaced apart rotatable members, introducing gas into the enclosure to establish and maintain an atmosphere of the gas within the enclosure, and supplying molten metal from the discharge member to successive moulds moving below the casting hood.

13. A method as claimed in claim 12 wherein the molten metal is magnesium or a magnesium alloy and the gas is selected from the group comprising nitrogen, argon, nitrogen/argon mixtures, dilute sulphur hexafluoride/carbon dioxide mixtures, dilute sulphur hexafluoride/carbon dioxide/dry air mixtures, sulphur dioxide/dry air mixtures, and dilute sulphur hexafluoride/dry air mixtures.

14. A method for casting molten metal utilising an apparatus as claimed in claim 13, the method comprising the steps of driving the series of ingot moulds around the spaced apart rotatable members, introducing gas into the enclosure to establish and maintain an atmosphere of the gas within the enclosure, and supplying molten metal from the discharge member to successive moulds moving below the casting hood.

* * * * *